US008037647B2

(12) United States Patent
Reaveley et al.

(10) Patent No.: US 8,037,647 B2
(45) **Date of Patent: *Oct. 18, 2011**

(54) PERFORATED PLATE SEISMIC DAMPER

(75) Inventors: Lawrence D. Reaveley, Salt Lake City, UT (US); Tyler J. Ross, Pleasant View, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 816 days.

This patent is subject to a terminal disclaimer.

(21) Appl. No.: 11/928,622

(22) Filed: Oct. 30, 2007

(65) Prior Publication Data

US 2008/0134592 A1 Jun. 12, 2008

Related U.S. Application Data

(60) Provisional application No. 60/863,561, filed on Oct. 30, 2006.

(51) Int. Cl.
*E04B 1/98* (2006.01)

(52) U.S. Cl. ..... 52/167.3; 52/167.9

(58) Field of Classification Search ..... 52/167.3, 52/167.4, 167.9

See application file for complete search history.

(56) References Cited

U.S. PATENT DOCUMENTS

| | | | | | |
|---|---|---|---|---|---|
| 4,027,389 | A * | 6/1977 | Atchisson | 30/303 |
| 4,373,649 | A * | 2/1983 | Ninomiya | 224/163 |
| 4,480,731 | A * | 11/1984 | Izeki et al. | 188/381 |
| 4,502,219 | A * | 3/1985 | Hibben | 30/153 |
| 4,606,125 | A * | 8/1986 | Jensen | 30/302 |
| 4,765,628 | A * | 8/1988 | Jensen | 473/589 |
| 4,805,359 | A * | 2/1989 | Miyake et al. | 52/167.6 |
| 4,807,362 | A * | 2/1989 | Prentice | 30/155 |
| 5,161,655 | A * | 11/1992 | Shimoda | 188/371 |
| 5,509,238 | A * | 4/1996 | Scalfati | 52/167.7 |
| 6,243,998 | B1 * | 6/2001 | MacKarvich | 52/167.3 |
| 6,389,761 | B1 * | 5/2002 | McKinnon | 52/167.3 |
| 6,651,395 | B2 * | 11/2003 | Capra | 52/167.8 |
| D510,009 | S * | 9/2005 | Lee | D8/99 |
| D557,330 | S * | 12/2007 | Parikh et al. | D17/20 |
| 2005/0155483 | A1 * | 7/2005 | Anderson | 84/422.3 |
| 2006/0150538 | A1 * | 7/2006 | Thomas | 52/167.3 |
| 2008/0022610 | A1 * | 1/2008 | Gjelsvik et al. | 52/167.3 |

OTHER PUBLICATIONS

U.S. Appl. No. 12/116,061, filed May 6, 2008, Reaveley.
Restriction Requirement dated Oct. 14, 2010 from U.S. Appl. No. 12/116,061.
Office Action dated Nov. 24, 2010 from U.S. Appl. No. 12/116,061.

* cited by examiner

*Primary Examiner* — Eileen D Lillis
*Assistant Examiner* — Alp Akbasli
(74) *Attorney, Agent, or Firm* — Workman Nydegger

(57) ABSTRACT

The present invention relates to apparatus and systems for absorbing seismic energy to prevent non-linear displacement in a structure. A seismic damper according to embodiments of the present invention includes a flat plate which can be perforated to include a plurality of apertures and/or cut-outs. A central aperture is formed in the flat plate and one or more cut-outs are formed along outer edges of the flat plate. The area of the flat plate between the aperture and the cut-outs forms one or more nodes on which stresses from seismic activity are focused, and which can deform to absorb energy, thereby reducing or preventing non-linear displacement of a brace system to which the seismic damper is attached. The nodes are located at the intersection between one or more tabs, the tabs being arranged to be connected to braces within the brace system.

20 Claims, 6 Drawing Sheets

PERFORATED PLATE SEISMIC DAMPER

CROSS-REFERENCE TO RELATED APPLICATIONS

The present applications claims the benefit of, and priority to, U.S. Provisional Application Ser. No. 60/863,561, filed on Oct. 30, 2006, and entitled "Perforated Plate Seismic Damper", which application is expressly incorporated herein by this reference.

BACKGROUND OF THE INVENTION

1. The Field of the Invention

Exemplary embodiments of the invention relate to the field of energy absorption. More particularly, the invention relates to apparatus and systems for absorbing and dissipating seismic energy.

2. The Relevant Technology

Building codes are set in place so that buildings, whether residential or commercial structures, are designed and constructed to have in place a minimum set of standards designed to allow the building to withstand tension and compression cycles. Such cycles may come about from any of a variety of different sources. For instance, such tension and compression cycles may be induced by earthquakes, winds, and other natural and/or man-made phenomena. For example, when an earthquake or similar event occurs, energy from the earthquake is transferred to the structure, causing the structure to oscillate, thereby also causing the structure and its support members to undergo a number of tensile and compressive cycles. Hopefully, in such an energy-inducing event (i.e. if the building codes are met, and the energy-inducing event is of a size less than the maximum for which the building codes were designed), the structure can withstand the tensile and compressive cycles without buckling or excessive deformation.

To meet these building codes, a frame-based structure can be designed and constructed with stiff cross-members which act as braces to withstand any compressive and tensile cycles occurring as a result of linear displacement. Typically, building code standards do not, however, require structures to exhibit high-energy dissipating characteristics that would allow for multiple cycles of non-linear displacement. Thus, a large earthquake, which may cause the structure to undergo non-linear displacement, may cause significant damage to the buildings despite compliance with the building codes. In particular, such structures are vulnerable to deformation and buckling in the event of a large earthquake or similar energy-inducing event which causes non-linear displacement and/or stress cycles above and beyond the minimum stresses that compliance with the building codes should withstand. Moreover, such problems are magnified in structures which have multiple stories as inter-story drift can be created which causes the stories to shift relative to each other.

To prevent or reduce the damage in the event of a major seismic event, structural dampers may be used which absorb high amounts of energy generated by the seismic event so as to reduce the displacement of the structure. In some cases, this damage is mitigated by limiting the structure to linear displacement where the stiff-cross members and bracing structures are less subject to deformation and buckling.

Exemplary structural dampers that can be used in this manner include various fluid-based and visco-elastic dampers. Each of these types of dampers are useful in that their components absorb the energy applied by a seismic event and thereby reduce structural displacement. Nevertheless, such damping structures are also very specialized and expensive.

As a result, such devices are typically limited to high-cost applications which require high-performance capabilities.

Accordingly, what are desired are apparatus and systems which provide a low-cost structural damper which can absorb significant amounts of energy to reduce displacement and damage to a structure. It is also desired to provide structural damping apparatus and systems which can be implemented in connection with new construction or which can be efficiently installed to retrofit and rehabilitate existing structures.

BRIEF SUMMARY OF THE INVENTION

Exemplary embodiments of the invention relate to a seismic damper which, when fixed to a structure, can absorb significant amounts of energy through deformation, thereby reducing the overall displacement and damage to a structure. A seismic damper of the system can include a single plate which is attached to two or more cross-members of a support structure. The single plate can include fuse areas configured to deform as a structure experiences seismic accelerations, and which can accumulate such deformation through multiple cycles. In embodiments in which a single plate damper is used, the damper can be simply and efficiently fabricated at low cost, thereby also allowing the damper to be cost efficiently replaced after excessive deformation or to be cost effectively installed in retrofit applications.

According to one embodiment of the present invention, a seismic damper is constructed to include a substantially flat plate. The substantially flat plate can also include a plurality of nodes along each side of the flat plate, and a plurality of tabs at each corner of the plurality of tabs, such that the tabs intersect at the nodes. The nodes can further be defined as the portions of the flat plate situated between an aperture within the flat plate and each of a plurality of cut-outs formed along each which has one or more apertures formed in the flat plate and one or more cut-outs formed along an outer edge of each side of the flat plate. Such a flat plate can be of any suitable shape and can be, for example, substantially square, having a thickness substantially less than the length of each of the four sides of the square.

The aperture and/or cut-outs can also have any suitable shape or size. For instance, an aperture may be circular or generally diamond-shaped. The cut-outs may be, for example, shaped to correspond to a portion of a circle and can thus be semi-circular in some cases. Furthermore, the aperture may be substantially centered in the flat plate and the cut-outs can be substantially centered along a respective edge of the flat plate. In other cases, the aperture and/or cut-outs may not be centered in such a manner.

According to another embodiment of the present invention, a perforated flat plate is used to form a seismic damper for use in substantially eliminating non-linear displacement in an attached support structure. The flat plate has a regular geometric shape and includes a central aperture formed in and extending through the flat plate. At least one cut-out is also formed and centered along each side of the regular geometrically shaped flat plate, and each cut-out has a curved shape that is either a semi-circle or an arc. A tab is further formed at each corner of the flat plate and each tab intersects two adjacent tabs at a node, thereby forming an equal number of tabs and nodes. Each tab may further be adapted so that it can be connected to a member of a diagonal brace system. For instance, each tabs may connect to a member of the diagonal brace structure such that when the corresponding member of the diagonal brace structure undergoes tension or compression, the connected tab undergoes a corresponding tension or compression.

Such a seismic damper may also include a fuse area centered on each node. In some cases, the nodes also concentrate forces applied to the perforated flat plate at the fuse areas. The fuse areas may have any suitable shape and, in some cases, are substantially hourglass shaped. In the same, or other cases, the fuse area may also have a length of any suitable size, including a length which is less than that of an adjacent cut-out.

While the plate and aperture can have any suitable shape, in some cases both are regular geometric shapes. For example, both can have about the same geometric shape, as in a case in which the plate is square and the aperture is substantially square or diamond-shaped. In other cases, the flat plate and aperture have different regular geometric shapes, such as when the flat plate is square and the aperture is substantially circular.

In another embodiment, a seismically damped structural system is disclosed which includes multiple cross-members intersecting at a particular location. A single plate seismic damper can also be attached to each cross-member at the particular location. Such a single plate seismic damper can have any suitable configuration. For instance, the seismic damper can include a flat plate that has one or more apertures formed therein, and one or more cut-outs formed therein. The aperture may be formed inside the flat plate and extend through the thickness of the plate. The cut-outs may also extend through the thickness of the plate, but may be formed in an edge of each side of the flat plate. In this manner, the aperture and cut-outs can define a plurality of tabs at each corner of the flat plate, and a node between each adjacent tab. The nodes may also have a width which varies substantially across the length of the node and can be configured such that when a force is applied to the cross-members and transferred to the flat plate, the transferred force is substantially concentrated at the nodes.

In some cases, the particular location at which the seismic damper is attached is substantially centered on the plurality of cross-members. Additionally, the nodes may further include a fuse area such that when the force is transferred to the flat plate, the concentration of the force is substantially contained within the fuse area. The fuse area may be rectangular, square, hourglass shaped, or may have any other suitable shape or configuration. Irrespective of its shape, the fuse area can be adapted to non-elastically deform when sufficient force is applied. In such a case, the non-elastic deformation of the fuse area may absorb forces applied to the cross-members and substantially limits the cross-members to linear displacement.

Non-elastic deformation may occur, for example, when there are large seismic events. Further, the single plate damper may be replaceable and selectively removable so that it can be replaced after deformation occurring in one or more seismic events.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope, nor are the drawings necessarily drawn to scale. The invention will be described and explained with additional specificity and detail through the use of the accompanying drawings in which.

DETAILED DESCRIPTION OF EXAMPLE EMBODIMENTS

Figure 1A:
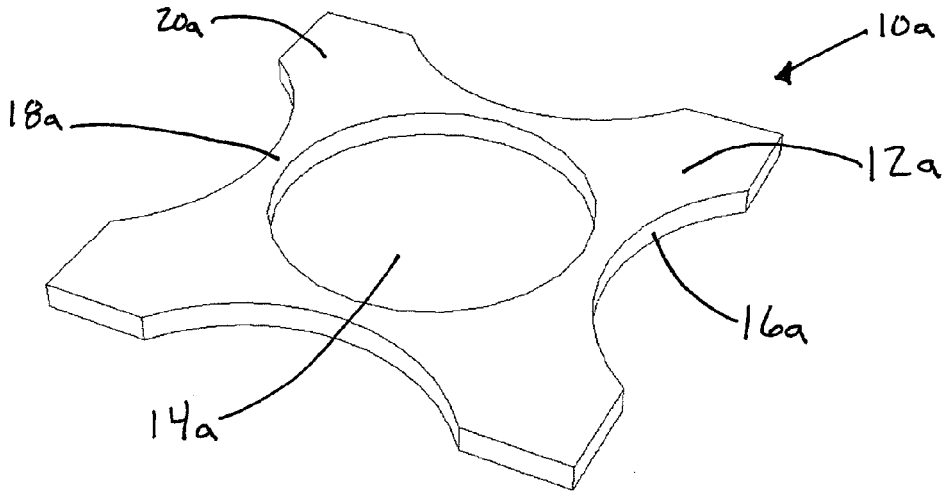
FIG. 1A illustrates a perspective view of a perforated plate seismic damper according to one embodiment of the present invention, the damper having perforations to focus shear and tension forces occurring during a seismic event on nodes within the damper.

Exemplary embodiments of the invention relate to a seismic damper which, when fixed to a structure, can absorb significant amounts of energy through deformation, thereby reducing the overall displacement and damage to a structure. A seismic damper of the system can include a single plate which includes fuse areas configured to deform as a structure experiences seismic accelerations, and which can accumulate such deformation through multiple cycles. In embodiments in which a single plate damper is used, the damper can be simply and efficiently fabricated at low cost, thereby also allowing the damper to be cost efficiently replaced after excessive deformation.

Reference will now be made to the drawings to describe various aspects of exemplary embodiments of the invention. It is understood that the drawings are diagrammatic and schematic representations of such exemplary embodiments, and are not limiting of the present invention. Accordingly, while the drawings illustrate an example scale of certain embodiments of the present invention, the drawings are not necessarily drawn to scale for all embodiments. No inference should therefore be drawn from the drawings as to the required dimensions of any invention or element, unless such dimension is recited in the appended claims. In the following description, numerous specific details are set forth in order to provide a thorough understanding of the present invention. It will be obvious, however, to one of ordinary skill in the art that the present invention may be practiced without these specific details.

FIGS. 1A-1D illustrate various views of an exemplary embodiment of a seismic damper 10*a* according to one embodiment of the present invention. In particular, FIGS.

1A-1D illustrate an exemplary seismic damper 10*a* which can absorb energy generated during a seismic event, and which may do so by stretching in a non-linear manner when a load reaches a threshold level, thereby limiting displacement of an associated support or bracing structure to non-linear displacement. In this manner, seismic accelerations may deform seismic damper 10*a*, such that non-linear deformation is substantially confined to seismic damper 10*a*, thereby reducing lateral displacement of an attached structure and possibly limiting inter-story drift.

As illustrated in FIGS. 1A-1D, seismic damper 10*a* can include, according to one exemplary embodiment, a plate 12*a* which can be configured to receive the seismic loading and deform in a non-linear manner. In the illustrated embodiment, plate 12*a* is generally square in shape, and has a thickness which is substantially less than the length of the sides of the square, although it will be appreciated that these dimensions are exemplary only and not limiting of the present invention. In fact, in other embodiments, plate 12*a* can have a variety of other shapes, including circular, rectangular, oval, triangular, hexagonal, or any other regular or irregular geometric shape.

In some embodiments, plate 12*a* can be configured to focus forces, such as tensile, compressive and/or shear forces, which can act on seismic damper 10*a*. For example, plate 12*a* may be constructed so as to concentrate any such forces primarily within specific, predetermined portions of plate 12*a*. Any suitable manner of focusing the forces to the specific, predetermined portions of plate 12*a* may be implemented. For example, and as illustrated in FIGS. 1A-1D, portions of plate 12*a* can be removed, such that a lesser area is provided within plate 12*a* for being acted upon by the associated forces. For instance, in the illustrated embodiment, an aperture 14*a* may be formed in seismic damper 10*a*. By having aperture 14*a* formed in seismic damper 10*a*, material is removed from plate 12*a* such that as a force is applied to seismic damper 10*a*, the forces are distributed over principally, or only, the un-removed portion of plate 12*a*. As discussed in more detail herein, as forces may be distributed unevenly over plate 12*a*, such forces may further be focused principally to interfaces between portions of plate 12*a* which are situated between the unevenly distributed forces.

Figure 1B:
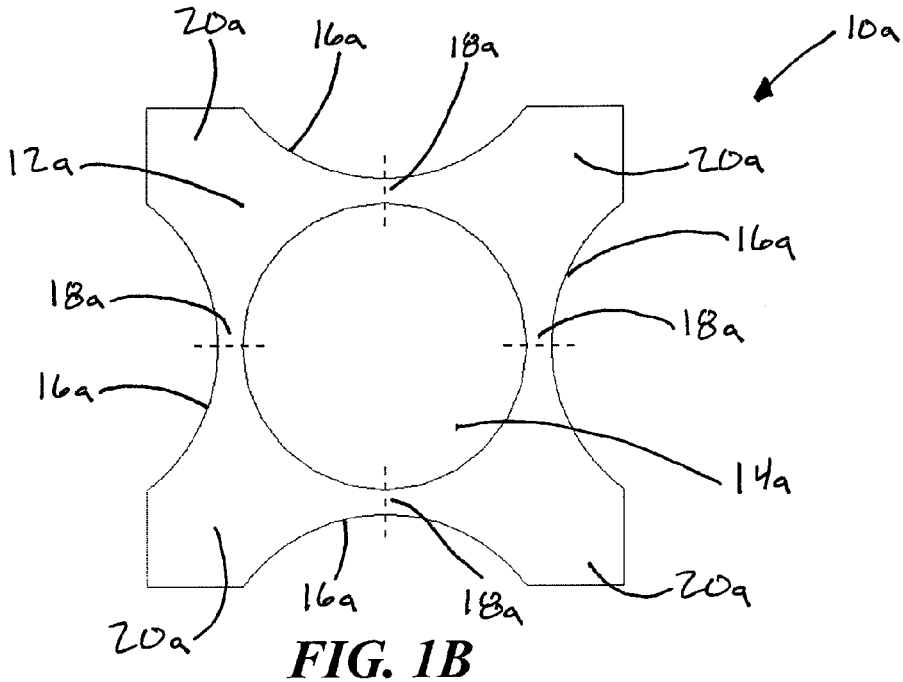
FIG. 1B illustrates a top view of the perforated plate seismic damper of FIG. 1A.
Figure 1C:
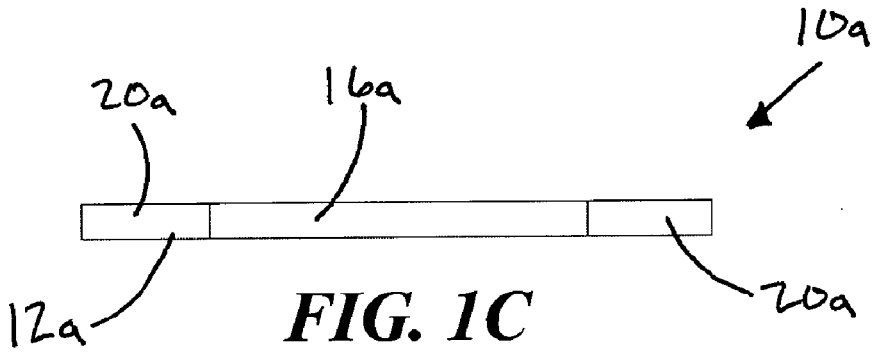
FIG. 1C illustrates a side view of the perforated plate seismic damper of FIGS. 1A and 1B.

As best illustrated in FIG. 1B, according to one embodiment of the invention, aperture 14*a* can have a substantially circular shape and may be substantially centered on plate 12*a*, although this arrangement is exemplary only. In other embodiments, for example, aperture 14*a* has other shapes (e.g., diamond, square, rectangle, octagonal, etc.) or placements (e.g., off-center). Moreover, in still other embodiments, more than one aperture may be formed in plate 12*a* and arranged such that the multiple apertures are centered or off-center relative to plate 12*a*.

Aperture 14*a* can be formed in plate 12*a* in any suitable manner, and no particular method for forming aperture 14*a* is to be considered limiting of the present invention. For example, plate 12*a* may be formed of a metal such as iron or steel. In such an exemplary embodiment, aperture 14*a* may be formed by machining plate 12*a* (e.g., drilling, milling, reaming, punching, cutting, slotting, broaching, grinding, etc.) or otherwise carving out aperture 14*a* in plate 12*a*. In other embodiments, however, aperture 14*a* may be formed substantially simultaneously with plate 12*a* such as by, for example, forming plate 12*a* with aperture 14*a* during a casting (e.g., die casting, sand casting, investment casting, etc.) or molding process.

To further allow seismic energy to be focused within seismic damper 10*a*, seismic damper 10*a* can include, in some example embodiments, one or more additional cut-outs that remove additional material from plate 12*a*. For example, in the illustrated embodiment of FIGS. 1A-1D, seismic damper 10*a* can include four cut-outs 16*a* which are each formed or machined along an outside edge of plate 12*a*. Cut-outs 16*a* can also be formed in any suitable manner, including any manner discussed herein for forming aperture 14*a*.

Cut-outs 16*a* may be adapted to have any of a variety of different shapes and configurations. In the illustrated embodiment, for example, cut-outs 16*a* have a substantially constant curvature, thereby forming an arc along each of the four sides of plate 12*a*. In other embodiments, however, exemplary cut-outs may have only straight edges and sharp corners, or may have other configurations. For example, exemplary cut-outs may take the form of any portion of a circle, triangle, square, rectangle, trapezoid, rhombus, hexagon, or virtually any other simple, complex, regular, irregular, symmetrical, or non-symmetrical geometric shape. Cut-outs 16*a* may also, by way of example and not limitation, be centered along the sides of plate 12*a*, although this feature is not necessary. For example, in alternative embodiments, a cut-out may be formed at a corner of a plate forming a seismic damper and/or multiple cut-outs may be formed on one or more side of such a plate.

Cut-outs 16*a* may also have any of a variety of sizes. For example, while the embodiment illustrated in FIGS. 1A-1D illustrates that the length of cut-outs 16*a* along the may be about equal to the diameter of circular aperture 14*a*, it will be appreciated in light of the disclosure herein that this feature is exemplary only. In particular, in other embodiments, cut-outs 16*a* may have lengths larger or smaller than the diameter, major axis, minor axis or length of one or more apertures within plate 12*a*. In other embodiments, a cut-out or aperture may be excluded. For example, in one embodiment, cut-outs are formed which extend substantially towards a middle of the flat plate, such that no aperture is also formed in the plate.

Figure 1D:
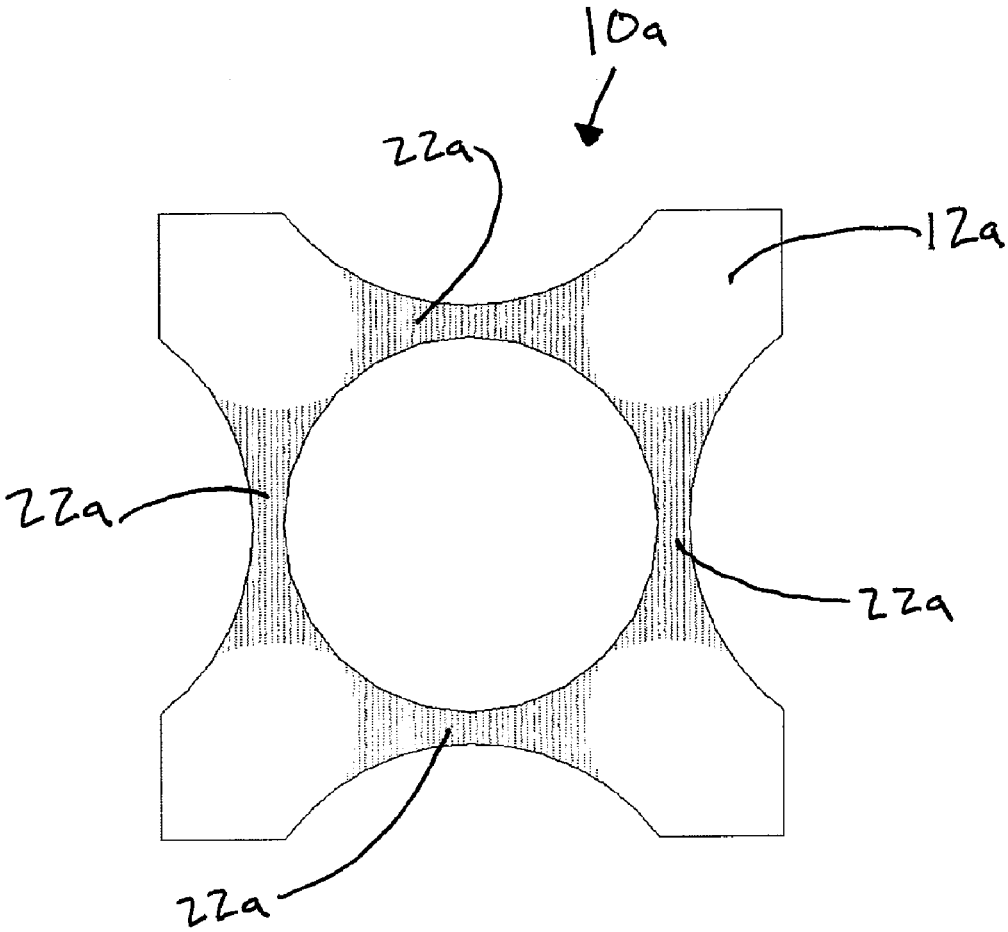
FIG. 1D illustrates a top view of the perforated plate seismic damper of FIG. 1A, further illustrating the nodes on which shear and tension forces are focused.

As noted above, the four cut-outs 16*a* are, in the illustrated embodiment, each substantially centered along a respective side of square plate 12*a*, thereby forming four tabs 20*a*, which are, in the illustrated embodiment, separated by the dashed lines. In this manner, each of tabs 20*a* may be aligned with, and include, a corner of plate 12*a*. Additionally, as best illustrated in FIGS. 1B and 1D, cut-outs 16*a* can form continuous arches on the sides of plate 12*a*, thereby causing plate 12*a* to neck down towards aperture 14*a*. For example, plate 12*a* can neck down to form four nodes 18*a* which are centered on the intersection between tabs 20*a*, at the point where plate 12*a* necks down.

Nodes 18*a* can be fuse points situated between, and connecting each of tabs 20*a*. Furthermore, in some cases, such as where plate 12*a* necks down at or near nodes 18*a*, nodes 18*a* can focus seismic energy which acts on seismic damper 10*a* and/or an associated support or bracing structure attached to seismic damper 10*a*.

Figure 2:
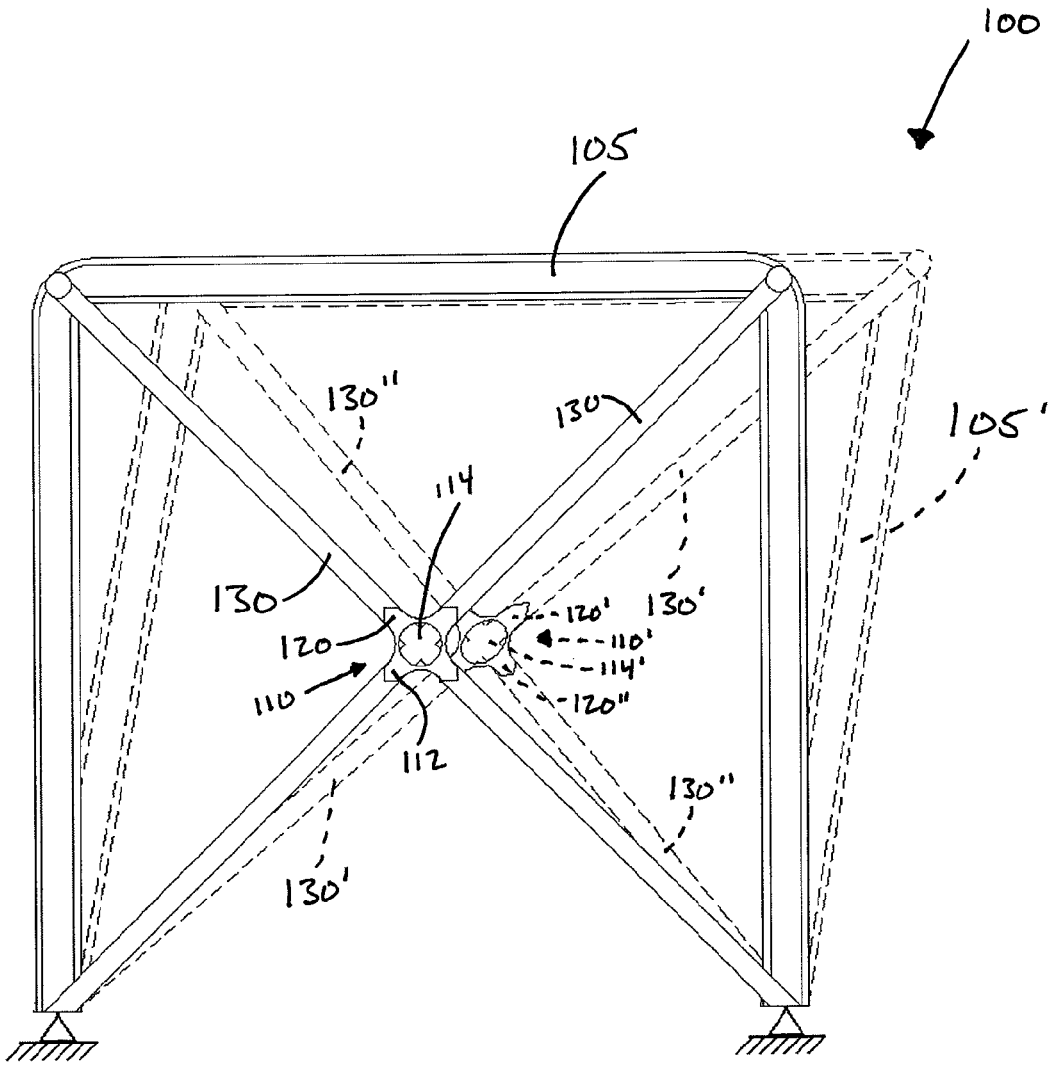
FIG. 2 illustrates a brace and support system having cross members on which a perforated plate seismic damper is implemented.

For example, with reference now to FIG. 2 a plurality of tabs 120 can be configured to be attached to one or more bracing members 130 of a brace system 105 within a seismic damping brace system. In the embodiment illustrated in FIG. 2, for instance, bracing members 130 are diagonal, cross-members which are each angularly offset from each other at about equal ninety degree intervals. In the illustrated embodiment, each cross-member can also be aligned with, and/or connected to, one of tabs 120 of seismic damper 110, thereby installing seismic damper 110 in about the center of the cross-members of the bracing system.

As a seismic or other event causes the support system to move laterally, brace system 105 can move laterally to a position such as that illustrated in FIG. 2 as brace system 105'. As will be appreciated, in the illustrated embodiment, brace system 105 may be an equilibrium position while brace system 105' may be a position which requires some external forces.

As brace system 105 moves laterally to the position of brace system 105', cross-members 130 can be placed in tension and/or compression. For instance, in brace system 105', the bracing cross-members 130' can be stretched and placed in tension as brace system 105' moves laterally in one direction, thereby elongating brace members 130'. In contrast, bracing cross-members 130" can be placed under compression, thereby reducing the length of brace members 130' from their equilibrium length in brace system 105. It will also be appreciated in view of the disclosure herein that a force which causes brace system 105 to move to position 105' may also oscillate. In such a manner, brace system 105 may move laterally in each direction (illustrated as left and right in FIG. 2). Thus, cross-members 130 may alternatively move from tension to compression.

As brace members 130 undergo tension and/or compression, seismic damper 110 can also be stressed in a tensile and/or compressive manner. For example, in the illustrated embodiment, a tab 120' of seismic damper 110' which is connected to a support member 130' under tension may also be subjected to tensile forces. In a similar manner, if a tab 120" of seismic damper 110' is connected to a support member 130" under compression, the corresponding tabs 120" may also be placed under compression.

As each tab 120 can be placed in compression or tension, as dictated by the associated support member to which it is attached, at a particular instant of time, one or more of tabs 120 (e.g., tabs 120') can be in tension while one or more other of tabs 120 (e.g., tabs 120") can be in compression. As a result, seismic damper 110 can be placed under both compressive and tensile stresses at any particular instant. Further, as noted above, as brace system 105 to which seismic damper 10*a* is attached oscillates, these compressive and tensile stresses can switch directions and magnitudes. Thus, while braces 130' and tabs 120', and braces 130" and tabs 120', are illustrated as being under tension and compression, respectively, when brace system 105 sways in the opposite direction, the tensile and compressive nature of such stresses can be reversed.

A seismic event may induce displacement within a structure such as seismic damping brace system 100. In small seismic events, the displacement may be largely linear, whereas a large seismic event can induce non-linear displacement within a structure and/or within seismic damping brace system 100. Such non-linear displacement can cause significant damage, however, if passed on to brace system 105. Accordingly, to reduce, and possibly eliminate, the non-linear movement of brace system 105, tensile and compressive stresses, and their associated shear stresses, may be concentrated in seismic plate 112, rather than in brace system 105, including cross-members 130. In particular, and as described herein, a seismic damper such as seismic damper 110, may include a plurality of nodes which have a reduced and possibly necked area which acts as fuse points between a plurality of tabs. As the shear, compressive, and/or tensile forces act on the plate, these forces can then be focused at the nodes, which may substantially confine non-linear strains therein, thereby allowing an attached structure, such as brace system 105 to move linearly. Thus, nodes within plate 112 can absorb significant amounts of energy to reduce the lateral displacement of brace system 105.

Moreover, as the seismic forces or other forces cause brace system 105 to move back-and-forth, diagonal cross-members 130 may experience a pattern of extension along one diagonal and contraction along the other. A similar pattern is transferred to seismic damper 110 where tabs 120 experience patterns of expansion and contraction. When seismic damper 110 is loaded beyond its elastic capacity, seismic damper 110 begins to deform in a non-elastic manner, thereby absorbing energy. This energy and deformation can also be focused on nodes within plate 112 which have, in one example, a reduced area.

In particular, as tensile and shear forces act on nodes such as nodes 18*a* in FIG. 1B, the area of the nodes can deform. Further, as brace system 105 moves in the opposite direction, shear forces acting on nodes can reverse direction to further deform the material. Moreover, as the shear forces reverse direction, the shear forces can act in opposite planes, thereby allowing for multiple cycles of loading.

Returning briefly to FIGS. 1B and 1D, an exemplary seismic damper 10*a* is illustrated in which nodes 18*a* are illustrated. In the illustrated embodiment, each of nodes 18*a* has an associated fuse area 22*a* which represents the portions of plate 12*a* which can undergo the bulk of non-linear displacement and non-elastic deformation which plate 12*a* experiences during a major seismic event. Thus, forces acting on seismic damper 10*a* can be substantially focused within fuse areas 22*a*, such that fuse areas 22*a* can absorb significant amounts of energy that would otherwise extend to an attached brace system, thereby allowing the attached brace system to instead undergo largely or wholly linear displacement, and thereby reducing, and possibly eliminating, damage associated with non-linear displacement.

In light of the disclosure herein, it will be appreciated that seismic damper 10*a* can, accordingly, accumulate deformation to allow the damper to perform through multiple cycles. Multiple cycles may occur, for example, in a single, major seismic event and/or in multiple major or minor seismic events. Following such an event or series of events, seismic damper 10*a* can be replaced.

Moreover, because seismic damper 10 can, in some example embodiments, comprise a single flat plate 12*a* having one or more apertures 14*a* and/or cut-outs 16*a* formed therein, seismic damper 10*a* can be easily fabricated and installed. For instance, flat plate 12*a* can be formed of a suitable metal, alloy, polymer, ceramic, composite, or other material. For example, flat plate 12*a* may be formed of a solid or hollow plate of steel. Such a plate can thus be manufactured at low cost, thereby allowing seismic damper 10*a* to be installed on any class of braced building to provide high-performance structural damping. Moreover, as tabs 20*a* can be connected to support braces, seismic damper 10*a* can be installed on new construction, and/or can be used to retrofit and rehabilitate existing construction, or can replace an existing seismic damper which has experienced excessive nodal deformations.

Although FIGS. 1A-1D and FIG. 2 illustrate similar seismic dampers that have a generally square configuration with a circular, central aperture and various arched cut-outs on the sides of the square plate, it will be appreciated that these features, collectively and individually, are merely representative of the present invention and not limiting thereof. Indeed, various other configurations are suitable and contemplated.

For example, in other embodiments, a brace system may have braces which are not equally offset at ninety degree angles as is illustrated in FIG. 2, such that a seismic damper (e.g., seismic damper 10*c* of FIG. 4) having a rectangular, rather than square, configuration would be desirable. In still other embodiments, a seismic damper may be attached to three brace members, such that a triangular seismic damper (e.g., seismic damper 10*d* of FIG. 5) can be used. Moreover, in some embodiments, a single central aperture may be eliminated and/or replaced by a plurality of apertures which are offset in a regular or irregular pattern. Similarly, one or more cut-outs may be formed on the sides or corners of a plate in a regular pattern, or one or more sides have a different pattern of cut-outs.

Accordingly, it will be appreciated that the dimensions and configuration of a seismic damper according to aspects of the present invention can be varied as necessary for any particular structural brace system, and for energy absorption to be provided according to a variety of different considerations. For instance, in some embodiments, seismic damper 10*a* may be about twenty inches by twenty inches. Moreover, in additional exemplary embodiments, central aperture 14*a* may be about twelve inches in diameter, cut-outs 16*a* have lengths of about twelve inches, and/or cut-outs 16*a* having a depth of about three inches. Moreover, plate 12*a* can have a thickness between one-half and five inches. It will be appreciated, however, that these dimensions are exemplary only and that in other embodiments, plate 12*a*, aperture 14*a* and cut-outs 16*a* may have other dimensions, sizes, shapes, or configurations.

Now turning to FIGS. 3A-3D, an exemplary embodiment of a seismic damper 10*b* is illustrated according to an alternative embodiment of the present invention, and can be configured to absorb energy so as to confine a corresponding brace system to displacement in substantially only a linear manner.

In particular, FIGS. 3A-3D illustrate an exemplary seismic damper 10*b* which can absorb energy generated during a seismic event by stretching in a non-linear manner when a load reaches a threshold level, thereby largely limiting displacement of an associated support or bracing structure to linear displacement. In this manner, seismic accelerations deform seismic damper 10*b*, such that non-linear deformation is substantially confined to seismic damper 10*b*, thereby reducing or eliminating non-linear displacement, reducing lateral displacement of the structure, and limiting inter-story drift.

As illustrated in FIGS. 3A-3D, a seismic damper 10*b* can include, according to one exemplary embodiment, a plate 12*b* which can be configured to receive the seismic loading and deform in a non-linear manner. In the illustrated embodiment, for example, plate 12*b* is generally square in shape, and has a thickness which is substantially less than the length of the sides of the square, although it will be appreciated that these dimensions are exemplary only and not limiting of the present invention. In fact, in other embodiments, plate 12*b* can have a variety of other shapes, including circular, oval, triangular, rectangle, hexagonal, octagonal, or any other regular or irregular geometric shape.

In some embodiments, plate 12*b* can be configured to focus forces (e.g., tensile, compressive, and/or shear forces) which may act on seismic damper 10*b* so as to substantially concentrate the forces within specific, predetermined portions of plate 12*b*. To focus any such forces, portions of plate 12*b* can be removed, such that a lesser area is provided within plate 12*b* for being acted upon by the associated forces. For example, in the illustrated embodiment, seismic damper 10*b* includes an aperture 14*b* which is formed in plate 12*b* of seismic damper 10*b*. By having aperture 14*b* formed in seismic damper 10*b*, material is removed from plate 12*b* such that as a force is applied to seismic damper 10*b*, the forces are distributed over the un-removed portion of plate 12*b* which has not been removed. In other words, by removing the material to form aperture 14*b*, a force applied to seismic damper 10*b* is distributed over a smaller area.

Moreover, adjacent aperture 14*b* plate 12*b* may include a plurality of nodes 18*b* at which forces are focused. As discussed herein, nodes 18*b* can act as fuse points between various tabs 20*b* which can be placed under different forces. As different forces act on tabs 20*b*, forces can further be focused at nodes 18*b*.

In the embodiment illustrated in FIGS. 3A-3D, aperture 14*b* is of a substantially diamond-shaped configuration, with rounded corners, and is substantially centered on plate 12*b* with the rounded corners of aperture 14*b* being centered along the four sides of plate 12*b*. It will be appreciated, however, that this arrangement is exemplary only. In other embodiments, for example, aperture 14*b* has other shapes (e.g. circular, square, rectangle, octagonal, sharp corners, etc.) or configurations (e.g. off-center, corners aligned with corners of plate 12*b*, etc.). Moreover, in still other embodiments, more than one aperture may be formed in plate 12*b*.

To further allow seismic energy to be focused within seismic damper 10*b*, seismic damper 10*b* can include, in some example embodiments, one or more additional cut-outs which remove additional material from plate 12*b*. For example, in the illustrated embodiment of FIGS. 3A-3D, seismic damper 10*b* can include four cut-outs 16*b*, one cut-out 16*b* being formed or machined on each outside edge of plate 12*b*. Cut-outs 16*b* can also have any of a variety of shapes and configurations. In the illustrated embodiment, for example, cut-outs 16*b* are about semi-circular in shape, thereby forming an arc along each of the four sides of plate 12*b*. Cut-outs 16*b* may also, by way of example and not limitation, be centered along the sides of plate 12*b*, although this feature is not necessary. Further, in alternative embodiments, multiple cut-outs may be formed on each side of plate 12*b* and/or be aligned in the corners of plate 12*b*.

Cut-outs 16*b* may also have any of a variety of different sizes. For example, semi-circular cut-outs 16*b* can have a length along the side of plate 12*b* which is about half the distance across aperture 14*b* (i.e., from point-to-point in aperture 14*b*). It will be appreciated in light of the disclosure herein, however, that such an arrangement is exemplary only. For example, in other embodiments, cut-outs 16*b* may have lengths and/or diameters which are more or less than half the distance across aperture 14*b*, or which is about the same size as, or larger than, the distance across aperture 14*b* within plate 12*b*.

In the illustrated embodiment, cut-outs 16*b* are each substantially centered along a respective side of square plate 12*b*, thereby forming four tabs 20*b*, which are, in the illustrated embodiment, separated by the dashed lines. In this manner, each of tabs 20*b* can be aligned with, and include, a corner of plate 12*b*. Additionally, cut-outs 16*b* can form continuous arches on the sides of plate 12*b*, which cause plate 12*b* to neck down towards aperture 14*b*. For example, as illustrated in FIGS. 3B and 3D, plate 12*b* can neck down to form four nodes 18*b* which are centered on the intersection between tabs 20*b*, and at about the point where plate 12*b* necks down to the smallest distance between cut-outs 16*b* and aperture 14*b*.

As described previously with respect to tabs 120 in FIG. 2, tabs 20*b* can, in some embodiments, be configured to attach to one or more braces in a corresponding brace system. Such an attachment may be made by mechanical fasteners (e.g. screws, rivets, nails, clamps, staples, etc.) which are integral with, or separable from, tabs 20*b*, by welding or adhesives, or by the use of any other suitable attachment means. In this manner, as the structure to which seismic damper 10*b* is attached undergoes seismic accelerations and moves laterally, seismic damper 10*b* can absorb substantial amounts of energy within nodes 18*b*, thereby possibly confining non-linear displacement to plate 12*b* and allowing the attached brace system to experience only linear displacement.

Figure 3A:
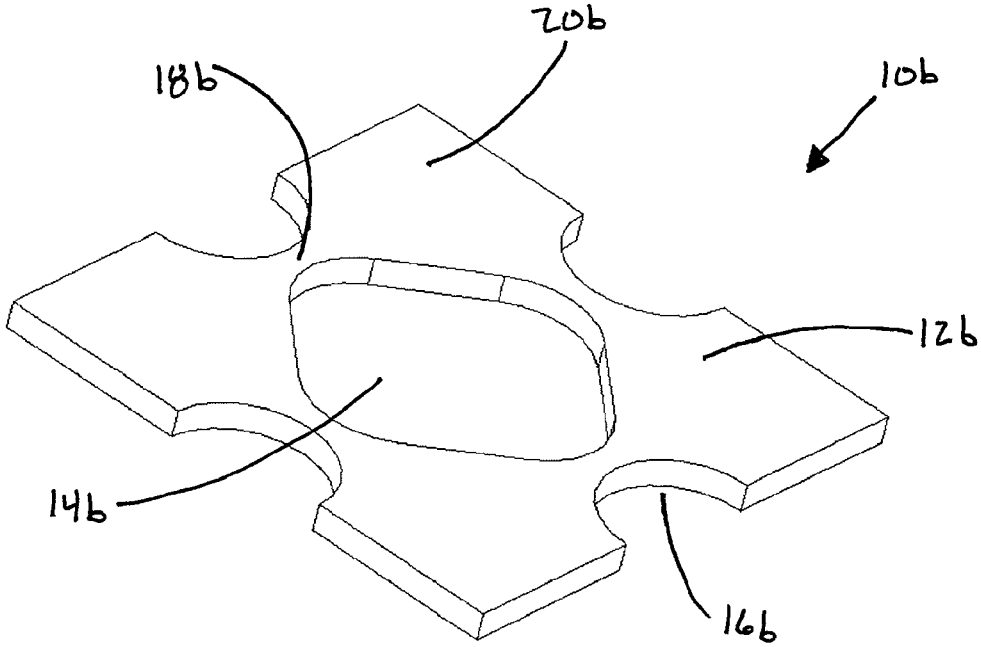
FIG. 3A illustrates a perforated plate seismic damper according to an alternative embodiment of the present invention, the damper having an alternative configuration of perforations for focusing forces on nodes within the damper.
Figure 3B:
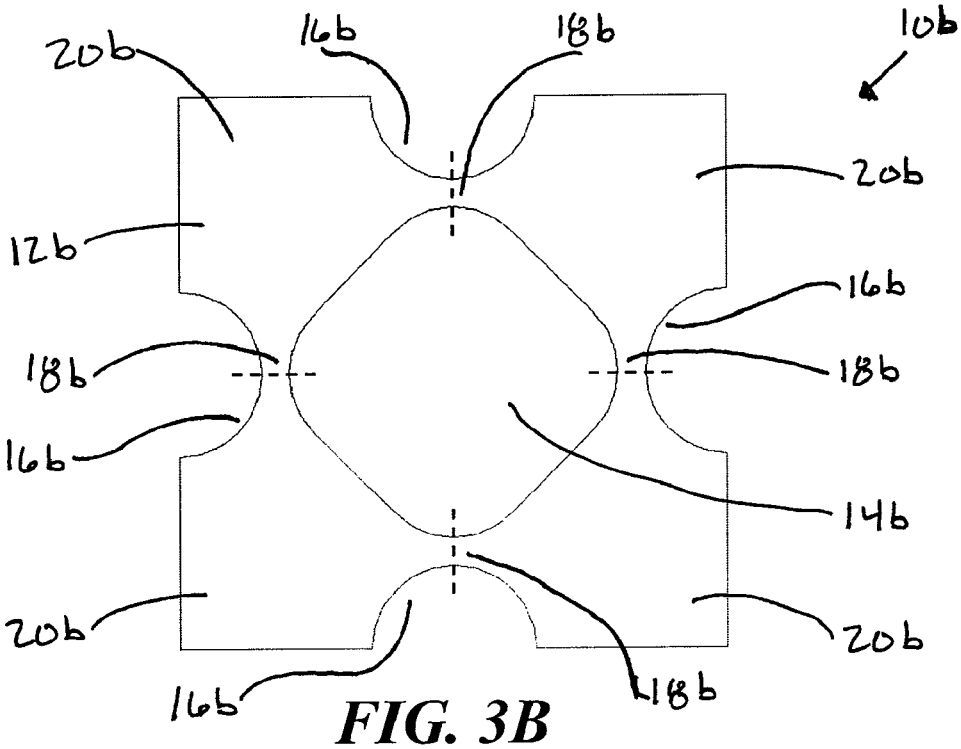
FIG. 3B illustrates a top view of the perforated plate seismic damper of FIG. 3A.
Figure 3C:
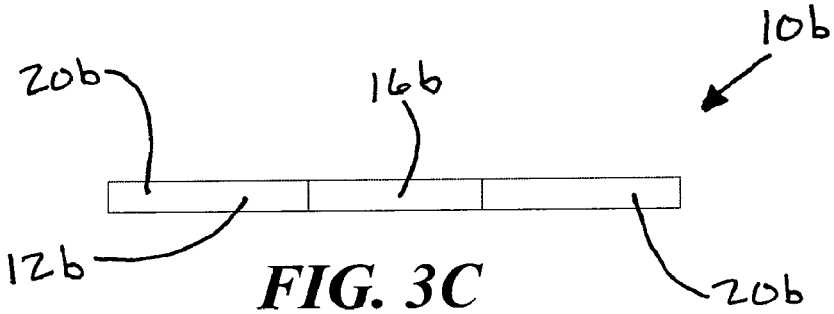
FIG. 3C illustrates a side view of the perforated plate seismic damper of FIGS. 3A and 3B.
Figure 3D:
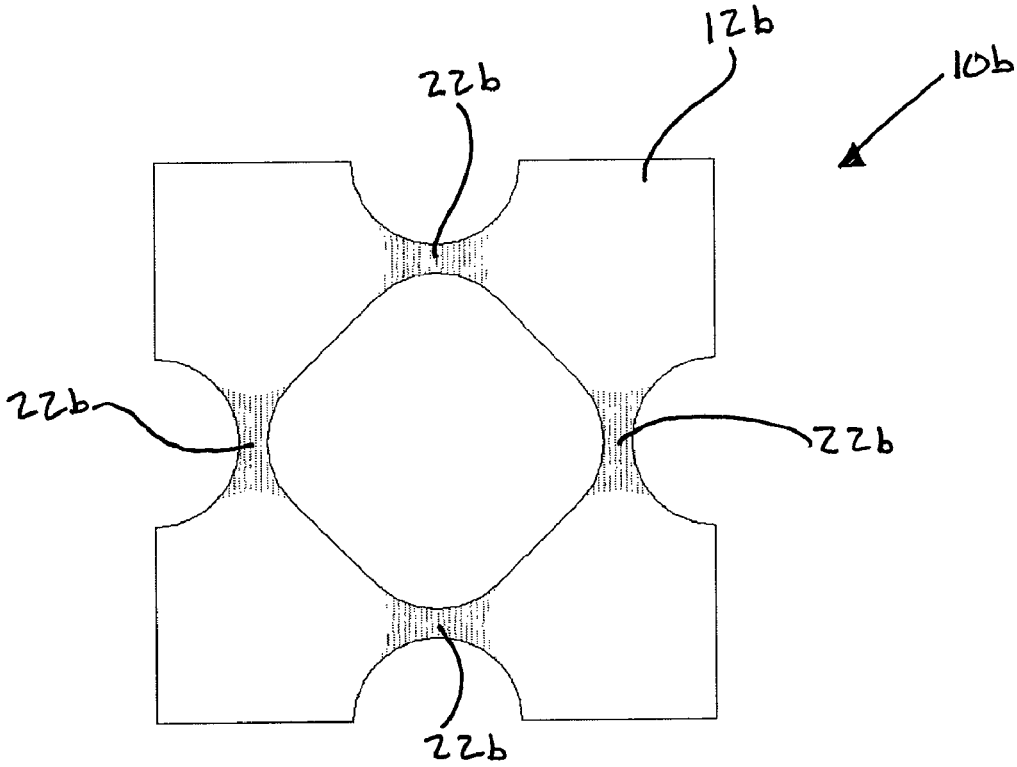
FIG. 3D illustrates a top view of the perforated plate seismic damper of FIG. 3A, further illustrating the nodes on which shear and tension forces are focused.

As illustrated in FIG. 3D, nodes 18*b* can have associated fuse areas 22*b* in which stresses caused by the seismic acceleration are concentrated. Such fuse areas 22*b* can undergo non-elastic deformation during a seismic event, thereby absorbing significant amounts of energy such that an attached brace system may be displaced in only a linear manner, thereby reducing, and possibly eliminating, damage associated with non-linear displacement.

In the embodiment illustrated in FIGS. 3B and 3D, it can be seen that fuse areas 22*b* may have a generally hour-glass shape that is centered on a corner of diamond-shaped aperture 14*b*, and may be sized such that the length of fuse areas 22*b* is less than a length of cut-outs 16*b*. It should be appreciated that this is exemplary only. For example, in FIGS. 1B and 1D, a fuse area 22*a* may also have a generally hour-glass shape and have a length less than a length of cut-out 16*a*, but may not be centered on corners of a diamond. In other embodiments, the shape of the fuse area in which stresses and/or strains are concentrated may take other shapes, and such shapes may be dependent on the dimensions and shapes of the features of an associated seismic damper and/or the material used to form the seismic damper.

Figure 4:
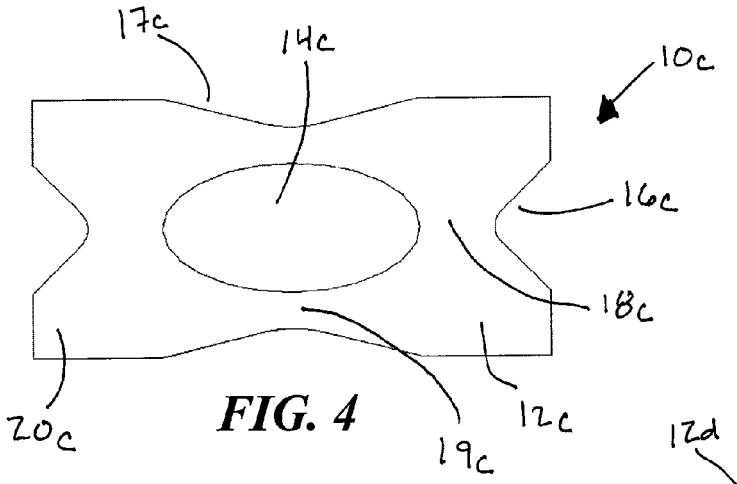
FIGS. 4-6 illustrate additional example embodiments of perforated plate seismic dampers according to other aspects of the present invention.
Figure 5:
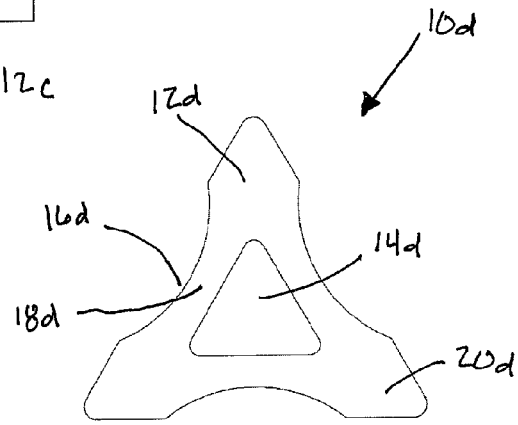
Figure 6:
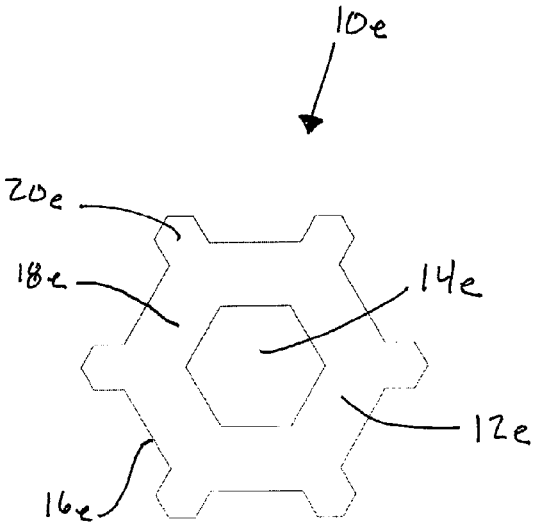

For example, FIGS. 4-6 illustrate various other example embodiments of exemplary seismic dampers which may be used to attach to various alternative brace structures and/or have fuse areas of different sizes, shapes, locations and/or configurations. In FIG. 4, for example, a seismic damper 10*c* is made from a substantially flat plate 12*c* that has a generally rectangular configuration. Such a shape may be desirable where, for example, seismic damper 10*c* is to be attached to four cross-braces of a support structure which are not equally offset at ninety-degrees. For example, seismic damper 10*c* may be attached to cross-members that are alternatively offset at one hundred-twenty degrees and sixty degrees, although any other unequal offset may also be accounted for.

In the illustrated embodiment, flat plate 12*c* may include one or more apertures 14*c* and/or cut-outs 16*c*, 17*c*. In the illustrated embodiment, for instance, an oval aperture 14*c* is formed in flat plate 12*c* and substantially centered therein. As disclosed herein, aperture 14*c* can also include any other shape, such as a circle or rectangle, and/or may optionally be off-center relative to rectangular plate 12*c*. Furthermore, as illustrated in FIG. 4, it is not necessary that cut-outs 16*c*, 17*c* each have the same shape and/or configuration. For instance, in the illustrated embodiment, cut-outs 16*c* are formed along the shorter edges of rectangular plate 12*c*, and are generally shaped as an acute triangle. In contrast, cut-outs 17*c* are formed along the longer edges of rectangular plate 12*c* and are generally shaped as an obtuse triangle.

By varying the size and/or shape of cut-outs 16*c*, 17*c*, it will also be appreciated that the size and/or shape of nodes 18*c*, 19*c*, as well as the fuse areas associated therewith, can also be different. For example, nodes 18*c* may have more distance between cut-outs 16*c* and aperture 14*c*, while nodes 19*c* may have a relatively shorter distance between cut-outs 17*c* and aperture 14*c*. However, the length of nodes 19*c* may also be corresponding larger than the length of nodes 18*c*, although this is exemplary only. In other embodiments, the distance between cut-outs 16*c*, 17*c* and aperture 14*c* may be about the same.

As further illustrated, seismic damper 10*c* can also include a tab 20*c* in each corner of rectangular plate 12*c*. The tab 20*c* can be defined by the cut-outs 16*c*, 17*c* and aperture 14*c*, and the tabs 20*c* can intersect at a line centered in nodes 18*c*, 19*c*. Further, in the illustrated embodiment, it can be seen that while each tab 20*c* may optionally have about the same shape or mirrored shape of the other tabs 20*c*, it is not necessary that tabs 20*c* by symmetrical. For instance, the length of tab 20*c* to cut-outs 16*c*, 17*c* may vary, thereby forming asymmetrical tabs 20*c*.

Now turning to FIG. 5, another example embodiment of a seismic damper 10*d* is illustrated. In the illustrated embodiment, seismic damper 10*d* is formed of a substantially flat plate 12*d* and can have a generally triangular shape. Specifically, in the illustrated embodiment, seismic damper 10*d* has triangular shape with rounded corners and rounded cut-outs 16*d* along each edge of flat plate 12*d*, although in other embodiments, the corners of flat plate 12*d* need not be rounded and/or cut-outs 16*d* may be omitted, have flat edges, or be otherwise shaped.

As also illustrated, in the example embodiment, flat plate 12*d* also can have an optional aperture 14*d* formed therein. In this embodiment, aperture 14*d* also has a generally triangular configuration and is aligned with the triangular configuration of flat plate 12*d*, although this is also exemplary and can be varied in any manner described herein. Three tabs 20*d* can also thusly be formed at or near each corner of flat plate 12*c* and can join at or near nodes 18*d*. As with the nodes in the other seismic dampers herein, nodes 18*d* may be locations within flat plate 12*d* at which stresses are concentrated to deform flat plate 12*d*. As flat plate 12*d* may be attached to a structural member which is subjected to seismic of other events, the concentration of stresses in nodes 18*d* can thus largely confine non-linear displacement and non-elastic deformation to flat plate 12*d*, and allow the attached structural member to undergo substantially only linear displacement.

Seismic damper 10*d* can be useful for a number of different applications. One application, for instance, is in connection with a structural member which has three joining cross-members. In such a system, each tab 20*d* can be connected to a respective cross-member and absorb the tensile, compressive, and/or shear forces applied thereto.

In view of the disclosure herein, it should be appreciated that a seismic damper can be constructed according to the present invention to attach to structural members and diagonal cross-members of virtually any size, shape, or configuration. For instance, FIG. 6 illustrates another example embodiment of a seismic damper 10*e* constructed for application in a structural support having six joining cross-members. In the illustrated embodiment, seismic damper 10*e* is formed from a flat plate having a substantially hexagonal shape.

Flat plate 10*e* can thus also include one or more optional apertures 14*e* of any suitable shape. For instance, aperture can be substantially circular, triangular, square, or elliptical, or may be substantially hexagonal as illustrated. Furthermore, although the illustrated embodiment illustrates substantially straight edges on flat plate 12*e* and aperture 14*e*, it will be appreciated that either or both of flat plate 12*e* and aperture 14*e* may have rounded or curved edges as may be desirable to, for example, reduce stress concentrations at discrete locations.

As further illustrated, seismic damper 10*e* can also include a plurality of cut-outs 16*e* centered along one or all of the edges of flat plate 12*e*. In this embodiment, cut-outs 16*e* form a portion of a trapezoid, and further define, in connection with aperture 14*e*, six tabs 20*e* and six nodes 18*e*, which are centered at the intersection of tabs 20*e*, thereby providing a generally wagon-wheel shape to seismic damper 10*e*. In the illustrated embodiment, and in contrast to some other embodiments disclosed herein, it can be seen that nodes 18*e* can have a generally constant width across a substantial length of node 18*e*, although this is exemplary only. In other embodiments, such as those others disclosed herein, a node can neck down and have a width that varies across substantially its entire length.

Accordingly, in view of the various embodiments disclosed herein, it will be appreciated that a seismic damper according to aspects of the present invention can include any of a variety of configurations, features, shapes, and sizes. Accordingly, the features and configurations illustrated and described herein are not limited to use with any particular sized, shaped or constructed seismic damper. Rather, each feature should be seen as being applicable for use with any other non-exclusive feature described herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A seismic damper, comprising:

a substantially flat plate, said plate further comprising:

a plurality of nodes, wherein said plurality of nodes are defined as portions of said plate substantially aligned between an aperture within said plate and each of a plurality of cut-outs formed along an edge of each of said sides of said plate, wherein each of said plurality of nodes has an interior surface defined by said aperture and an outer surface defined by one of said plurality of cutouts; and a plurality of tabs to be connected to cross bars, each node of said plurality of nodes being connected to two of said adjacent tabs, and said plurality of tabs intersecting at said plurality of nodes.

2. A seismic damper as recited in claim 1, wherein said plate is substantially square, and a thickness of said plate is less than the length of each of the four sides of said square.

3. A seismic damper as recited in claim 1, said aperture being substantially circular.

4. A seismic damper as recited in claim 1, said aperture being substantially diamond-shaped.

5. A seismic damper as recited in claim 1, said plurality of cut-outs each having a shape of a portion of a circle.

6. A seismic damper as recited in claim 5, said plurality of cut-outs each having a generally semi-circular shape.

7. A seismic damper as recited in claim 1, wherein said aperture is substantially centered in said plate, and wherein each of said cut-outs are substantially centered along an edge of said plate.

8. A seismic damper for use in substantially eliminating non-linear displacement of an attached support structure, the seismic damper comprising:

a perforated flat plate having a regular geometric shape having corners, said perforated flat plate including:

at least one cut-out centered along each side of said perforated flat plate, each of said cut-outs having a curved shape selected from a group consisting of: a semi-circle and an arc;

a central aperture formed in and extending through said perforated flat plate, said central aperture having a length greater than or equal to a total length of at least one of said cut-outs;

tabs at each corner of said flat plate, each of said tabs intersecting with two adjacent tabs at a node, thereby forming an equal number of tabs and nodes, wherein each of said tabs is configured to be attached to a member of a diagonal brace system; and a node between each adjacent tab, wherein said nodes are aligned between said central aperture and said cut-outs, wherein each of said nodes has an interior surface defined by said central aperture and an outer surface defined by one of said cut-outs, and wherein said nodes are configured such that when a force is applied to said diagonal brace system and transferred to said perforated flat plate, said force transferred to said perforated flat plate is concentrated substantially at said nodes.

9. A seismic damper as recited in claim 8, further comprising a fuse area centered on each node, said fuse area being configured to deform in a non-elastic manner when a load on said perforated flat plate reaches a predetermined threshold level.

10. A seismic damper as recited in claim 9, wherein said fuse area is substantially hourglass shaped.

11. A seismic damper as recited in claim 9, said fuse area having a length less than a length of an adjacent cut-out.

12. A seismic damper as recited in claim 9, wherein said perforated flat plate and said aperture have different, regular geometric shapes.

13. A seismic damper as recited in claim 8, wherein each of said tabs is configured to be attached to the member of the diagonal brace system such that when the member of the diagonal brace system undergoes tension, the corresponding tab undergoes tension, and when the member of the diagonal brace system undergoes compression, the corresponding tab undergoes compression.

14. A seismically damped structural system comprising:

a plurality of cross-members intersecting at a particular location; and a single plate seismic damper attached to each of said plurality of cross-members at said particular location, said single plate seismic damper comprising:

a flat plate having corners formed therein;

one or more apertures formed inside said flat plate and extending fully through a thickness of said flat plate; and one or more cut-outs formed in an edge of each side of said flat plate, each of said cut-outs extending fully through the thickness of said flat plate;

wherein said one or more apertures and said one or more cut-outs define:

a plurality of tabs, wherein a tab is formed in each corner of said substantially flat plate; and a node between each adjacent tab of said plurality of tabs, wherein said nodes are aligned between at least one of said one or more apertures and said one or more cut-outs, wherein at least a portion of each of said nodes has an interior surface defined by at least one of said one or more apertures and an outer surface defined by said one or more cut-outs, and wherein said nodes are configured such that when a force is applied to said cross-members and transferred to said flat plate, said force transferred to said flat plate is concentrated substantially at said nodes.

15. A seismically damped structural system as recited in claim 14, wherein said particular location is substantially centered within said plurality of cross-members, and wherein said single plate seismic damper is attached to, and substantially centered on, said plurality of cross-members.

16. A seismically damped structural system as recited in claim 14, wherein each of said nodes includes a fuse area centered on each of said nodes.

17. A seismically damped structural system as recited in claim 16, wherein each fuse area is substantially hourglass shaped.

18. A seismically damped structural system as recited in claim 16, wherein said fuse area is configured to non-elastically deform when a force greater than a particular amount is applied, and wherein said non-elastic deformation of said fuse area absorbs forces applied to said cross-members and limits said plurality of cross-members to substantially linear displacement.

19. A seismically damped structural system as recited in claim 14, wherein said single plate seismic damper is configured to non-elastically deform when undergoing large seismic events.

20. A seismically damped structural system as recited in claim 19, wherein said single plate seismic damper is configured to be replaced subsequent to non-elastic deformation.

* * * * *

UNITED STATES PATENT AND TRADEMARK OFFICE

CERTIFICATE OF CORRECTION

PATENT NO. : 8,037,647 B2
APPLICATION NO. : 11/928622
DATED : October 18, 2011
INVENTOR(S) : Reaveley et al.

It is certified that error appears in the above-identified patent and that said Letters Patent is hereby corrected as shown below:

Column 2
Line 35, change “each which” to --each of which--
Line 63, change “each tabs” to --each tab--

Column 6
Line 25, remove [along the]

Column 9
Line 50, change “rectangle” to --rectangular--

Column 10
Line 1, change “aperture 14*b* plate 12*b*” to --aperture 14*b* and plate 12*b*--

Column 12
Line 3, change “by” to --be--
Line 27, change “seismic of other” to --seismic or other--
Line 47, change “Flat plate 10*e*” to --Flat plate 12*e*--
Line 48, change “aperture” to --apertures--

Signed and Sealed this
Twentieth Day of March, 2012

David J. Kappos

David J. Kappos
*Director of the United States Patent and Trademark Office*